United States Patent [19]

Carlstedt

[11] Patent Number: 4,735,328

[45] Date of Patent: Apr. 5, 1988

[54] SPLIT WEDGE DRAFT GEAR WITH CENTER FRICTION PLATE

[75] Inventor: Richard A. Carlstedt, Wheaton, Ill.

[73] Assignee: Miner Enterprises, Inc., Geneva, Ill.

[21] Appl. No.: 941,661

[22] Filed: Dec. 15, 1986

[51] Int. Cl.[4] ..... B61G 9/10

[52] U.S. Cl. ..... 213/33; 267/168; 267/205; 213/32 R; 213/22

[58] Field of Search ..... 213/22, 24, 31, 32 R, 213/32 A, 32 B, 33, 34, 35, 36, 40 D, 37, 49, 43; 267/4, 168, 9 A

[56] References Cited

U.S. PATENT DOCUMENTS 1,939,303 12/1933 Herndon ..... 213/33

*Primary Examiner*—Sherman D. Basinger
*Assistant Examiner*—Edwin L. Swinehart

[57] ABSTRACT

The draft gear includes a single center friction plate and a pair of spaced apart friction wedges. Six major friction surfaces are defined, four of which are engaged upon contact with the follower, the other two being engaged after about one-half inch of travel. Three major groups of angles are defined, a first being between the friction wedges and the shoes, a second between the friction wedges and the release wedge and a third between the shoes and the spring seat. These groups of angles cooperate to insure that the draft gear will release upon removal of external force.

10 Claims, 4 Drawing Sheets

SPLIT WEDGE DRAFT GEAR WITH CENTER FRICTION PLATE

FIELD OF THE INVENTION

This invention relates generally to energy absorbers and in particular, to a draft gear which has a central friction plate and friction wedges on either side thereof to provide resistance to external forces and to be less adversely effected by non-normal loads transmitted by the follower.

BACKGROUND OF THE INVENTION

Plate-type friction draft gear devices are well-known in the prior art. One of these devices is characterized in U.S. Pat. No. 4,305,514 which includes a centrally located friction wedge disposed between the other various elements. These elements include a pair of movable friction plates, a pair of tapered stationary friction plates, and a pair of friction shoes, all of which are positioned generally in the open end of the housing of the draft gear. During operation, initially the follower exerts force upon the centrally located friction wedge which moves inwardly a predetermined amount where upon the friction plates are then engaged. The friction wedge itself lies upon the center line of the draft gear having its major axis coextensive therewith while the friction plates are located an equal distance on either side. As is well known in the prior art, plate-type friction draft gears are most effective when the forces are normal to the major axis of the draft gear. Needless to say this is often not the situation encountered in actual commercial environment, especially with a single centrally located friction wedge. An additional and most critical factor with any draft gear is the release of the elements when the external load, whether normal or not, is released.

BRIEF SUMMARY OF THE INVENTION

Briefly stated, the invention is a plate-type friction draft gear which has a pair of friction wedges lying one on either side of the centrally disposed major axis of the draft gear. A friction plate is centrally disposed along the major axis between a pair of barrier plates which in turn contact the friction wedges. Thus, the friction wedges are spaced away from, on either side of, the major axis whereby non-normal forces are more effectively dealt with. This by virtue of the fact that the friction wedges and cooperating shoes have a substantially wide stance. The friction wedges each cooperate with shoe means disposed on either side thereof that in turn cooperate with first and second wear liner plates that in turn contact and are anchored to the housing of the draft gear. A release wedge is situated below the friction plate/friction wedge combination and a spring seat is positioned between the friction elements and a series of metal coil springs which function in their well-known manner. It has been found that the separation of the friction wedge into two separate component parts allows the draft gear to better react to non-normal loading. Additionally, the angles of the friction surfaces between the friction wedge and the shoes, between the friction wedge and the release wedge and between the shoe and the spring seat are important to achieve a smooth release of the components once the load has been released.

A principal object of the present invention is to provide a draft gear which incorporates two separate friction wedges which is better able to deal with non-normal loading and which engages four of its six frictional surfaces during the initial one-half inch of gear compression resulting in a smoother riding draft gear and spreading wear over a greater number of parts. But another object of this invention is to provide particular relationships between the various friction surfaces whereby providing a simple, effective and economic means of eliminating gear sticking once the external load is released. Still another object is to provide a draft gear wherein the friction wedges are positioned out from the major axis of the gear whereby the friction plate is protected from side loads. Another object of this invention is to provide barrier plates which encase the friction plate such that there is no wear of the friction plate of the draft gear housing.

DESCRIPTION OF THE DRAWINGS

The following description of the invention will be better understood by having reference to the attached drawings wherein.

DETAILED DESCRIPTION OF THE INVENTION

Figure 1:
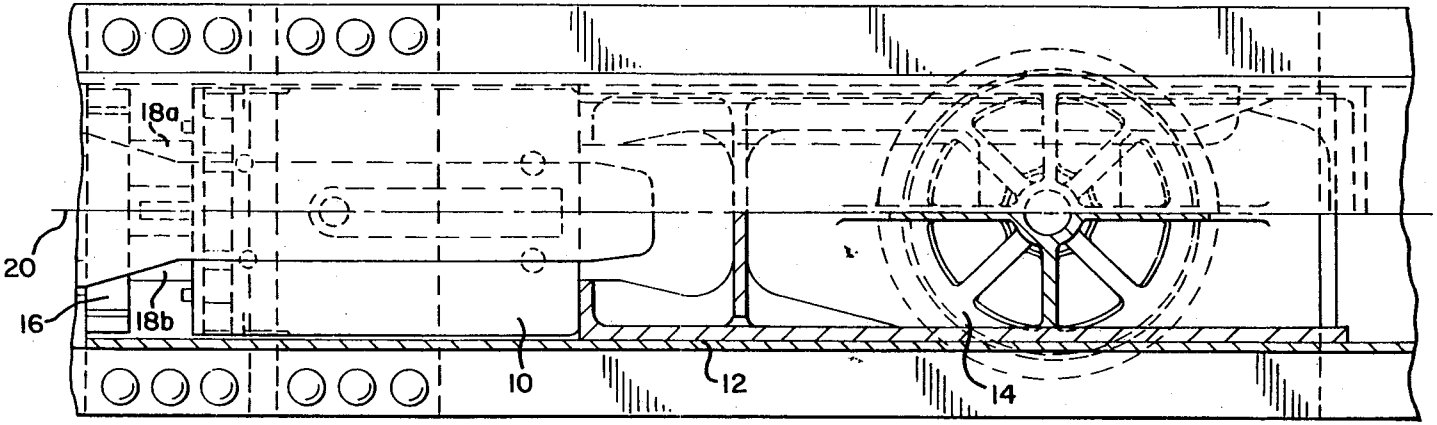
FIG. 1 is a fragmented view showing the draft gear in relation to the sill and bolster with parts being broken away while other parts are omitted to simplify the illustration.
Figure 5:
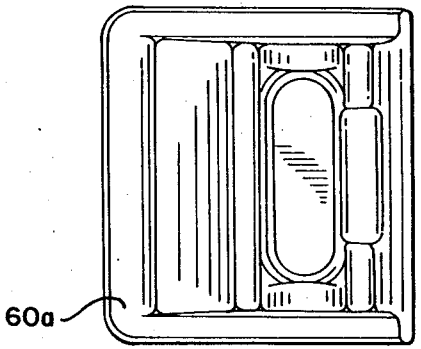
FIGS. 4 through 10 are plan views of the component parts of the gear.
Figure 4:
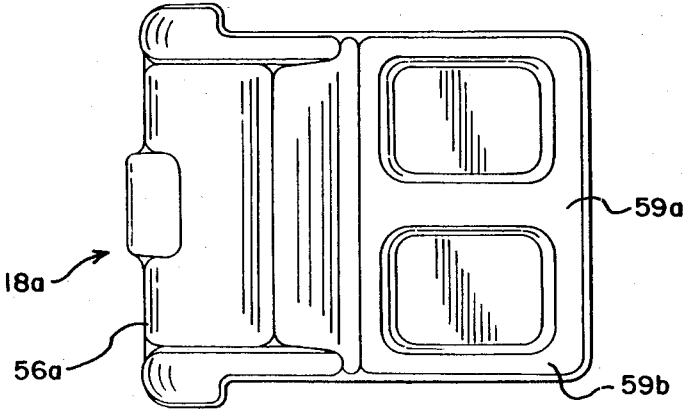

In FIG. 1 is illustrated the friction draft gear means 10 showing its relationship with the sill means 12 and a portion of the bolster means 14. A follower means 16 is shown positioned adjacent the friction wedges **18*a* and 18*b* while the centrally located major axis of the draft gear means 10 is represented by the line 20. It should be understood that for all practical purposes that the major axis divides the gear into two symmetrical halves, and as can be shown in FIG. 2 runs down the center of the friction plate means 22**.

Figure 2:
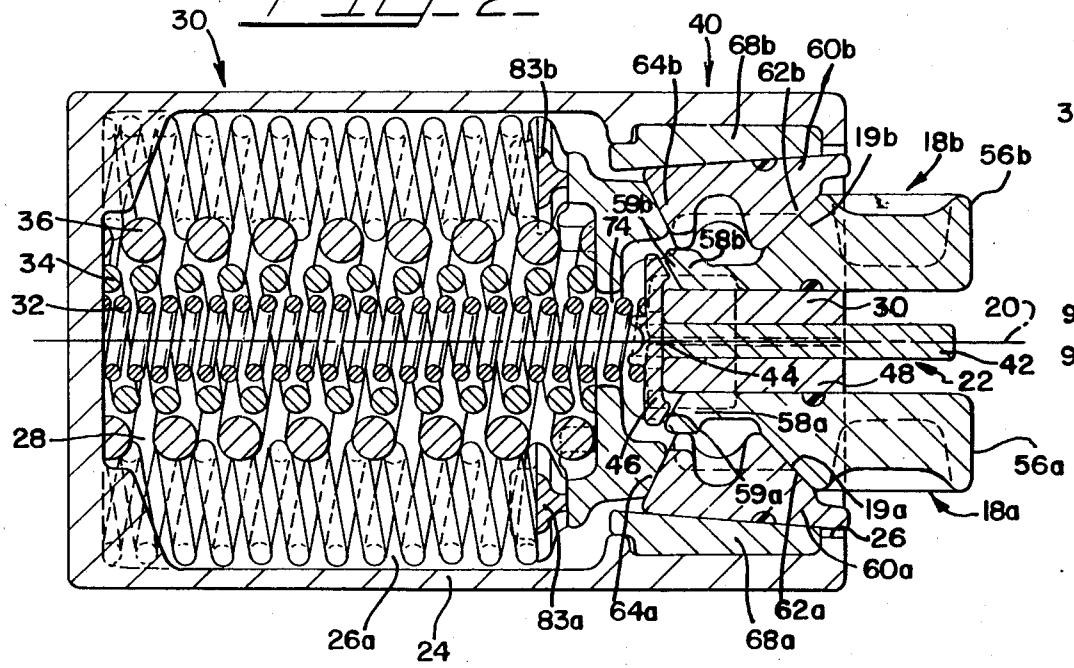
FIG. 2 is a plan view of the draft gear in cross-section.
Figure 6:
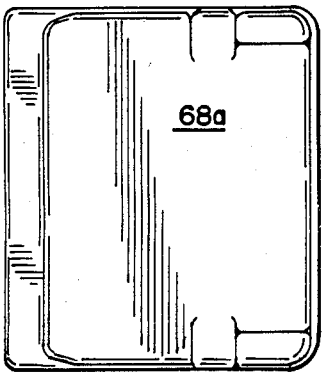

As shown in FIG. 2, the draft gear means 10 includes a hollow housing means 24 having a generally tubular body with a first open end means 26 and a second closed end means or bottom 28, the major axis line 20 being centrally disposed the length thereof. A spring system means 30 is disposed within the lower portion **26*a* of said hollow housing means 24 adjacent said second closed end means 28 and includes a inner coil spring means 32, a middle coil spring means 34, an outer coil spring means 36 and first, second, third and fourth corner spring means 38*a*, 38*b*, 38*c* and 38*d***.

A friction system means 40 is disposed within said first open end means 26 and includes the following elements. Firstly, the friction plate means 22, which is centrally disposed along said major axis 20 having a first end means 42 which extends outwardly from said hollow housing means 24 and a second end means 44 which is shown in contact with the release wedge 46. Disposed one on either side of said friction plate means are first and second barrier plate means 48 and 50. Each having first and second end means **54*a* and 54*b* being situated in said first open end means and second end means 52*a*** and 52*b* adjacent said second end of said friction plate means. It being understood that said first and second barrier plate means 48 and 50 are anchored against longitudinal movement with respect to the housing means 24 but respond to lateral pressures.

First and second frictional wedge means 18*a* and 18*b* are disposed on either side of said barrier plates and have first end means 56*a* and 56*b* and second end means 58*a* and 58*b*. Said first end means extending out from said hollow housing means while said second end means 58*a* and 58*b* are situated adjacent to said release wedge means 46. During operation, angled surfaces 59*a* and 59*b* of wedge means 18*a* and 18*b* cooperate with angled surfaces 61*a* and 61*b* of said release wedge means 46. First and second shoe means 60*a* and 60*b* are disposed one on either side of said first and second friction wedge means. Each having first angled end means 62*a* and 62*b* which cooperate with the angled portion means 19*a* and 19*b* of said friction wedges and second angled end means 64*a* and 64*b* which cooperate with the angled portion means 65*a* and 65*b* of spring seat means 66. First and second wear liner means 68*a* and 68*b* are disposed one on either side of said first and second shoe means. Each being anchored to said housing means 24 against both lateral and longitundal movement.

The release wedge means 46 includes a horizontally extending body portion means 70 and first and second tapered end means 61*a* and 61*b* which cooperate with said angled surface means 59*a* and 59*b* of said friction wedge means whereby defining an angle relationship with respect to said major axis 20.

The spring seat means 66 having an aperture 74 located in the center thereof also includes angled surface means 65*a* and 65*b*, which as previously stated are designed to cooperate with the angled end means 64*a* and 64*b* of the shoe means. An angled relationship is thus defined with respect to said major axis or center line 20. The spring seat means 66 bears against the middle coil means 34 and the outer coil means 36 and against corner coil means 38*a*, 38*b*, 38*c* and 38*d*, via the spring harness means 83*a* and 83*b*. The inner coil means 32 passes through the aperture 74 and bears directly against the release wedge 46 whereby the angled portion means 61*a* and 61*b* can be brought against the corresponding portions of the friction wedges 59*a* and 59*b*.

As is apparent, the various angled surfaces define an angle, when a line passing therethrough is extended to the center line 20.

In order to achieve the release characteristics necessary to communicate the draft gear of this invention, I have found that three of the angles are important.

Figure 11:
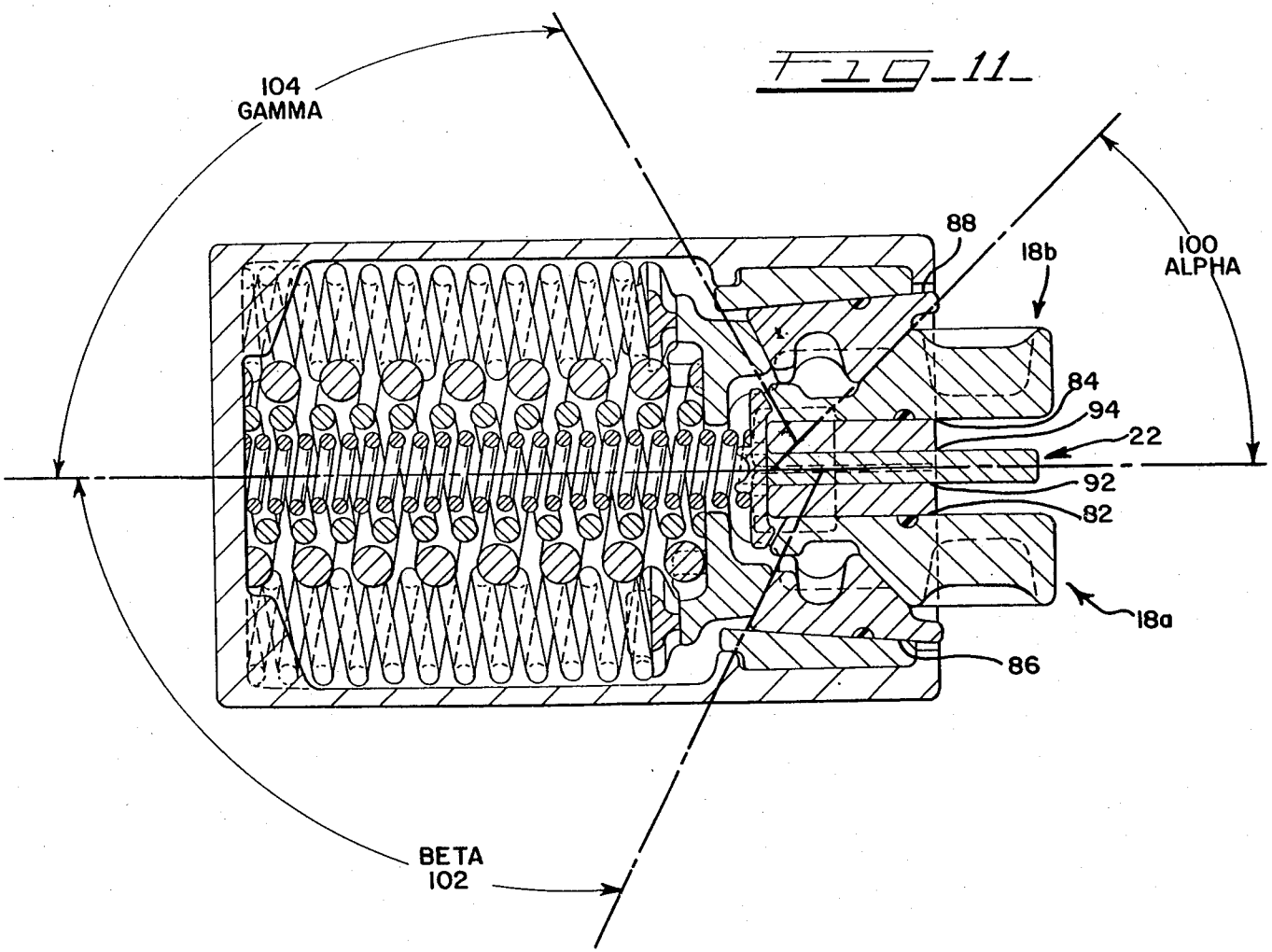
FIG. 11 is a second plan view of the draft gear in cross-section showing the various angles involved.

Referring to FIG. 11, I have identified these angles. A first angle system means 100 or alpha exists between the first group of angled portions 19*a* and 19*b* of the friction wedges and said first group of angled means 62*a* and 62*b* of the shoe means 60*a* and 60*b*. I have found this angle to be 47 degrees, plus or minus 2 degrees, for optimum performance.

The shoe means 60*a* and 60*b* have a second angled system 102 or beta between a second group of angled means 64*a* and 64*b* which cooperate with the angled means 65*a* and 65*b* of the spring seat means 66. I have found angle beta to be 66 degrees, plus or minus 2 degrees, for optimum performance of the draft gear means.

The third angle system 104 or gamma which I have found to be important is that existing between the second group of angled surface means 59*a* and 59*b* of the friction wedge means 18*a* and 18*b* and the angled means 61*a* and 61*b* of the release wedge means 46. I have discovered that in order to achieve optimum release characteristics the angle gamma should be about 60 degrees, plus or minus 2 degrees.

Figure 3:
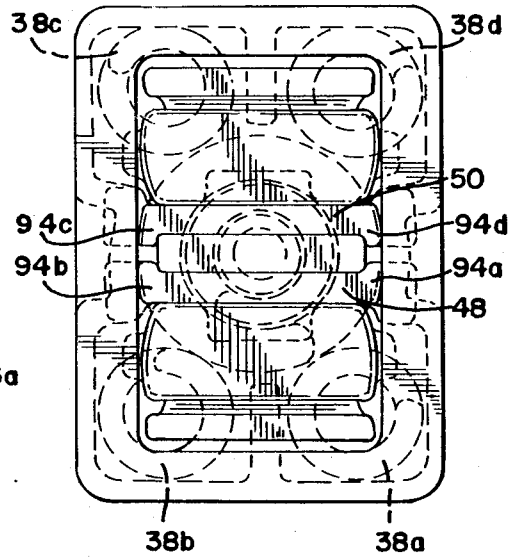
FIG. 3 is a top view of the draft gear of FIG. 2.
Figure 7:
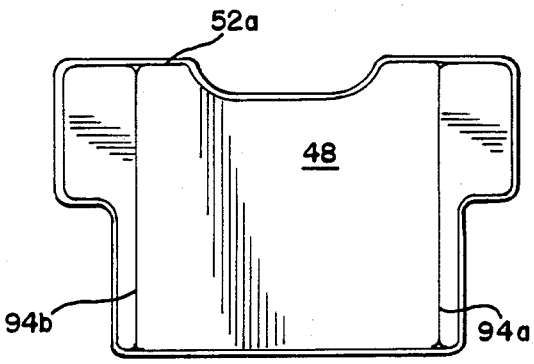
Figure 8:
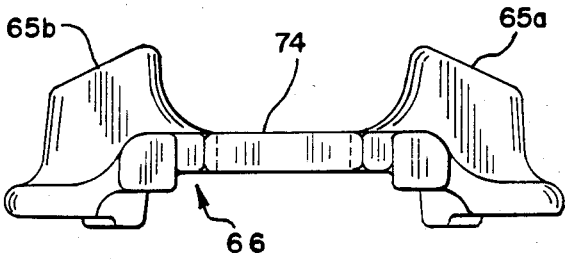
Figure 10:
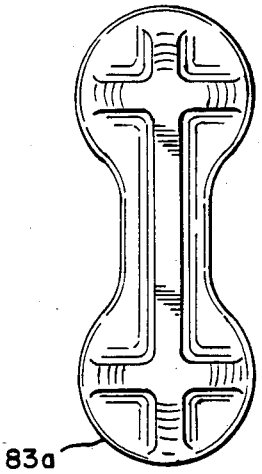
Figure 9:
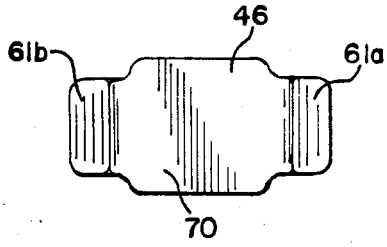

An additional feature to be found in my design is the provision of the lip means 94*a*, 94*b*, 94*c* and 94*d* on the first and second barrier plates 48 and 50. As seen in FIGS. 3 and 7, these lip means wrap around the friction plate 22, whereby during operation, rubbing contact with the housing and subsequent wear is prevented.

OPERATION

During compression of the draft gear means 10 the friction wedges 18*a* and 18*b*, which are always in contact with the follower plate 16, are pushed into the open end means 26 of a housing means 24. The friction wedges 18*a* and 18*b* act upon the shoe means 60*a* and 60*b* to wedge them against the wear liner plates 68*a* and 68*b*. Thus, during the initial one-half inch of compression which is an amount of movement common in normal train service, the friction plate is idle. Frictional resistance is provided by the wedges and shoes only, whereby the invention hereunder consideration makes use of four of its six frictional surfaces, these being first frictional surface means 82, second 84, third 86 and fourth 88, these four frictional surfaces being actuated during the initial one-half inch of travel of the friction wedges. This results in a smoother gear with wear being spread over a greater number of parts and thus more evenly distributed among those parts subject to wear. Most importantly, because the friction wedges 18*a* and 18*b* are spaced away from the major axis of the gear, they are better able to compensate for compression forces which are not normal.

After approximately one-half inch of travel of the friction wedges 18*a* and 18*b*, the follower means 16 contacts the centrally located friction plate means 22 and all three elements begin moving into the housing. As is apparent, this travel over one-half inch engages the last two of the six frictional surfaces, these being fifth frictional surface means 92 and sixth 94. The wedging action of the friction wedges 18*a* and 18*b* against the barrier plates 48 and 50 results in the friction plate 22 being squeezed therebetween as it is being forced into the housing. The two sides of the friction plate means 22, the flat back side of each friction wedge 18*a* and 18*b* and the action of each shoe 62*a* and 62*b* against each wear liner 68*a* and 68*b* provide for the total of six principal surfaces per draft gear. As is apparent, these surfaces respectfully engage against and rub against both sides of each barrier plate and one side of each wear liner plate. Four other frictional interfaces which of lesser influence, although still important to over-all gear operation, include those between the friction wedge means and shoe means and those between the shoe and spring seat contact surfaces.

During this time the spring seat means 66 which always remains in contact with the corresponding shoe means is pushed by the shoe means toward the bottom wall of the housing means 24. This results in the compression of the middle coil spring 34, the outer coil spring 36 and the four corner spring means 38. As is apparent the spring seat 66 cooperates with the two spring harnesses holding the four corner springs in position. As was previously stated, the inner spring means 32 extends through a hole 74 in the spring seat 66 and is thus independent of any movement of the spring seat.

It will be noted that after slight compression movement of the friction wedge means 18*a* and 18*b* the release wedge means 46 is contacted by the angled portion means thereof and they move as a unit thereafter. The inner spring means 32 is compressed by this movement of the release wedge. The slightly greater travel of the spring seat 66 for a given displacement of the friction wedges 18*a* and 18*b* will result in the friction plate 22 always being separate from and out-traveled by the spring seat 66 during compression. The friction wedges 18*a* and 18*b*, therefore, provide both spring force, and friction forces of resistance while the friction plate means 22 provides only frictional resistance.

When the compressive force from the gear is removed, the release sequence begins. At the beginning, to overcome initial static friction between the friction wedges 18*a* and 18*b* and the barrier plates 48 and 50, the release wedge 46, due to the action of the inner coil 32 and because of the various angled relationships between the parts, breaks the tight surface contact. The friction wedges are then pushed outward of the housing by the shoes with additional assistance from the independently spring loaded release wedge 46. The returning spring seat, in the mean time, picks up the friction plate and returns it to its initial position. The shoes are also returned by the spring seat and simultaneously push the friction wedges.

Although a particular preferred embodiment of the invention has been disclosed above, for illustrative purposes, it will be understood that variations or modifications thereof which lie within the scope of the appended claims are fully contemplated.

The embodiments of the invention in which an exclusive property or privilege is claimed are defined as follows:

What I claim is:

1. A draft gear mechanism having a center line along its major axis comprising:

a hollow housing means having a generally tubular body with a first open end means and a second closed end means;

a spring system means disposed within said hollow housing means adjacent said second closed end means inluding inner coil means, middle coil means, outer coil means and corner coil means;

a friction system means disposed adjacent said first open end means including:

a friction plate means centrally disposed along said major axis having a first end means which extends out of said hollow housing means and a second end means situated down in said first open end means;

first and second barrier plate means disposed one on either side of said friction plate, said first and second barrier plate means being anchored against longitudinal movement and responding to lateral pressure;

first and second friction wedge means, said first friction wedge being disposed on one side of said first barrier plate means and said second friction wedge means being disposed on one side of said second barrier plate means, each of said first and second friction wedge means having first and second angled means;

first and second shoe means, said first shoe means being disposed on one side of said first friction wedge means and said second shoe means being disposed on one side of said second friction wedge means, each of said first and second shoe means having first and second angled means;

first and second wear liner plate means, said first wear line plate means, being disposed on one side of said first shoe means and said second wear liner plate means being disposed on one side of said second shoe means, and being anchored to said first open end means against longitudinal and lateral movement;

a release wedge means having a horizontally extending body portion and having first and second angled means cooperable with said second angled means of said friction wedge means; and a spring seat means having an aperture means and an angled portion means cooperating with said second angled means of said shoe means.

2. The draft gear mechanism of claim 1 wherein:

said first angled means of said friction wedge means cooperate with said first angled means of said shoe means to define an angle with respect to said center line of about 47 degrees, plus or minus 2 degrees.

3. The draft gear mechanism of claim 2 wherein:

said second angled means of said shoe means cooperate with said angled means of said spring seat means to define an angle with respect to said center line of about 66 degrees, plus or minus 2 degrees.

4. The draft gear mechanism of claim 3 wherein:

said second angled means of said friction wedge means cooperate with said angled means of said release wedge means to define an angle with respect to said center line of about 60 degrees, plus or minus 2 degrees.

5. The draft gear mechanism of claim 1 wherein:

a first frictional surface is defined between said first friction wedge means and said first barrier plate means;

a second frictional surface is defined between said second friction wedge means and said second barrier plate means;

a third frictional surface is defined between said first shoe means and said first wear liner means;

a fourth frictional surface is defined beteen said second shoe means and said second wear liner means; and whereby in the initial one-half inch of travel of said first and second friction wedge means, said first, second, third and fourth frictional surfaces are engaged.

6. The draft gear mechanism of claim 5 wherein:

a fifth frictional surface is defined between said first barrier plate means and said frictional plate means;

a sixth frictional surface is defined between said second barrier plate means and said friction plate means; and whereby after said initial one-half inch of travel of said first and second friction wedge means, said fifth and sixth frictional surfraces are engaged.

7. The draft gear mechanism of claim 1 wherein:

said first and second barrier plate means have lip means which encase said friction plate means, whereby during operation rubbing contact between said friction plate means and said housing means and subsequent wear is prevented.

8. A draft gear mechanism having a center line along its major axis for cooperation with a follower means comprising:

a hollow housing having a first open end means and a second closed end means;

a spring system means disposed within said hollow housing means adjacent said closed end means;

a friction system means disposed adjacent said first open end means including:

a friction plate means disposed along said major axis;

first and second barrier plate means disposed on either side of said friction plate;

first and second friction wedge means, said first friction wedge means being spaced on one side of said first barrier plate means and said second friction wedge means being spaced on one side of said second barrier plate means, each of said first and second friction wedge means having first and second angled means whereby being less adversely effected by non-normal loads transmitted by said follower means;

first and second shoe means, said first shoe means being disposed on one side of said first friction wedge means and said second shoe means being disposed on one side of said second friction wedge means, each of said first and second shoe means having first and second angled means, said first angled means of said first and second shoe means cooperating with said first angled means of said first and second friction wedge means;

first and second wear liner plate means;

a release wedge means having angled means cooperable with said second angled means of said first and second friction wedge means; and a spring seat means having an angled portion cooperating with said second angled means of said shoe means.

9. The draft gear mechanism of claim 8 wherein:

said first angled means of said friction wedge means cooperate wtih said first angled means of said shoe means to define an angle with respect to said center line of about 47 degrees, plus or minus 2 degrees;

said second angled means of said shoe means cooperate with said angled means of said spring seat means to define an angle with respect to said center line of about 66 degrees, plus or minus 2 degrees; and said second angled means of said friction wedge means cooperate with said angled means of said release wedge means to define an angle with respect to said center line of about 60 degrees, plus or minus 2 degrees.

10. The draft gear mechanism of claim 9 wherein:

a first frictional surface is defined between said first friction wedge means and said first barrier plate means;

a second frictional surface is defined between said second friction wedge means and said second barrier plate means;

a third frictional surface is defined between said first shoe means and said first wear liner means;

a fourth frictional surface is defined between said second shoe means and said second wear liner means;

whereby in the initial one-half inch of travel of said first and second friction wedge means, said first, second, third and fourth frictional surfaces are engaged;

a fifth frictional surface is defined between said first barrier plate means and said friction plate means;

a sixth frictional surface is defined between said second barrier plate means and said friction plate means; and whereby after said initial one-half inch of travel of said first and second friction wedge means, said fifth and sixth frictional surfaces are engaged.

* * * * *

US004735328B1

REEXAMINATION CERTIFICATE (2131st)

United States Patent [19]

Carlstedt

[11] B1 4,735,328

[45] Certificate Issued Nov. 16, 1993

[54] SPLIT WEDGE DRAFT GEAR WITH CENTER FRICTION PLATE

[75] Inventor: Richard A. Carlstedt, Wheaton, Ill.

[73] Assignee: Miner Enterprises, Inc., Geneva, Ill.

Reexamination Request:
No. 90/002,865, Oct. 16, 1992

Reexamination Certificate for:

| | |
|---|---|
| Patent No.: | **4,735,328** |
| Issued: | **Apr. 5, 1988** |
| Appl. No.: | **941,661** |
| Filed: | **Dec. 15, 1986** |

[51] Int. Cl.[5] ..... B61G 9/10

[52] U.S. Cl. ..... 213/33; 267/168; 267/205; 213/32 R; 213/22

[58] Field of Search ..... 213/22, 24, 31, 32 R, 213/32 A, 32 B, 33-36, 40 D, 37, 49, 43

[56] References Cited

U.S. PATENT DOCUMENTS

| | | | |
|---|---|---|---|
| 1,497,250 | 6/1924 | Sommerfeld | 213/31 |
| 1,500,146 | 7/1924 | O'Conner | 213/32 A |
| 1,939,303 | 12/1933 | Herndon | 213/33 |
| 2,701,063 | 2/1955 | Tucker | 213/31 |
| 2,916,163 | 12/1959 | Campbell | 213/33 |
| 4,076,129 | 2/1978 | Housman | 213/33 |
| 4,305,514 | 12/1981 | Zanow et al. | 213/32 R X |
| 4,645,187 | 2/1987 | Kanjo et al. | 213/33 X |

*Primary Examiner*—Ed Swinehart

[57] ABSTRACT

The draft gear includes a single center friction plate and a pair of spaced apart friction wedges. Six major friction surfaces are defined, four of which are engaged upon contact with the follower, the other two being engaged after about one-half inch of travel. Three major groups of angles are defined, a first being between the friction wedges and the shoes, a second between the friction wedges and the release wedge and a third between the shoes and the spring seat. These groups of angles cooperate to insure that the draft gear will release upon removal of external force.

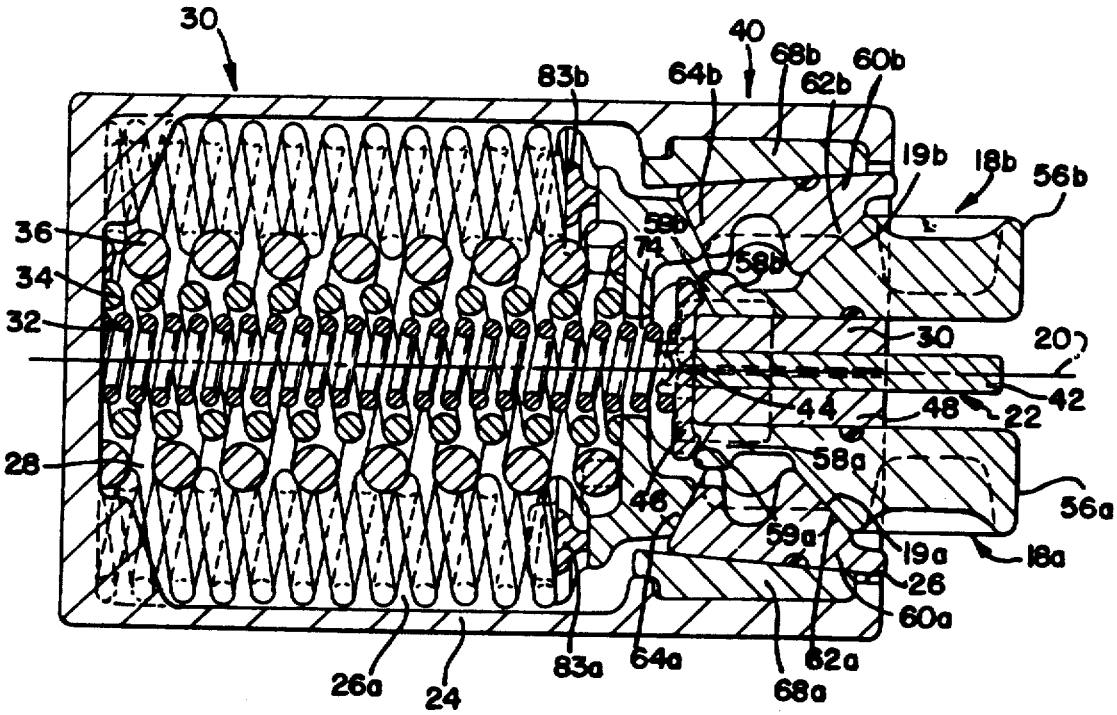

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-10 are determined to be patentable as amended.

1. A draft gear mechanism having a center line along its major axis comprising:

a hollow housing [means] having a generally tubular body with a first open end [means] and a second closed end [means];

a spring system disposed within said hollow housing [means], adjacent said second closed end [means], including *an* inner coil [means], *a* middle coil [means], *an* outer coil [means] and corner [coil means] *coils*;

a friction system [means] disposed adjacent said first open end [means] including:

a friction plate [means] centrally disposed along said major axis having a first end [means] which extends out of said hollow housing [means] and a second end [means] situated down in said first open end [means];

first and second barrier [plate means] *plates* disposed one on either side of said friction plate, said first and second barrier [plate means] *plates* being anchored against longitudinal movement and responding to lateral pressure;

first and second friction [wedge means] *wedges*, said first friction wedge being disposed on one side of said first barrier plate [means] and said second friction wedge [means] being disposed on one side of said second barrier plate [means], each of said first and second friction [wedge means] *wedges* having first and second angled [means] *surfaces*;

first and second [shoe means] *shoes*, said first shoe [means] being disposed on one side of said first friction wedge [means] and said second shoe [means] being disposed on one side of said second friction wedge [means], each of said first and second [shoe means] *shoes* having first and second angled [means] *ends;* first and second wear liner [plate means] *plates*, said first wear liner plate [means], being disposed on one side of said first shoe [means] and said second wear liner plate [means] being disposed of one side of said second shoe [means], and being anchored to said first open end [means] against longitudinal and lateral movement;

a release wedge [means] having a horizontally extending body portion and having first and second [angled means] *tapered ends* cooperating with said second angled [means] *surfaces* of said friction [wedge means] *wedges*; and a spring seat [means] having an aperture [means] and [an] *a pair of* angled [portion means] *surfaces* cooperating with said second angled [means] *ends* of said [shoe means] *shoes.*

2. The draft gear mechamism of claim 1 wherein:

said first angled [means] *surface* of *each of* said friction [wedge means cooperate] *wedges cooperates* with said first angled [means] *end* of *each of* said [shoe means] *shoes* to define an angle with respect to said center line of about 47 degrees, plus or minus 2 degrees.

3. The draft gear mechanism of claim 2 wherein:

said second angled [means] *end* of *each of* said [shoe means cooperate] *shoes cooperates* with said angled [means] *surfaces* of said spring seat [means] to define an angle with respect to said center line of about 66 degrees, plus or minus 2 degrees.

4. The draft gear mechanism of claim 3 wherein:

said second angled [means] *surface* of *each of* said friction [wedge means cooperate] *wedges cooperates* with said [angled means] *first and second tapered ends* of said release wedge [means] to define an angle with respect to said center line of about 60 degrees, plus or minus 2 degrees.

5. The draft gear mechanism of claim 1 wherein:

a first frictional surface is defined between said first friction wedge [means] and said first barrier plate [means];

a second frictional surface is defined between said second friction wedge [means] and said second barrier plate [means];

a third frictional surface is defined between said first shoe [means] and said first wear liner [means];

a fourth frictional surface is defined between said second shoe [means] and said second wear liner [means]; and whereby in the initial one-half inch of travel of said first and second friction [wedge means] *wedges*, said first, second, third and fourth frictional surfaces are engaged.

6. The draft gear mechanism of claim 5 wherein:

a fifth frictional surface is defined between said first barrier plate [means] and said [frictional] *friction* plate [means];

a sixth friction surface is defined between said second barrier plate [means] and said friction plate [means]; and whereby after said initial one-half inch of travel of said first and second friction [wedge means] *wedges*, said fifth and sixth frictional surfaces are engaged.

7. The draft gear mechanism of claim 1 wherein:

said first and second barrier [plate means] *plates* have [lip means] *lips* which encase said friction plate [means], whereby during operation rubbing contact between said friction plate [means] and said housing [means] and subsequent wear, is prevented.

8. A draft gear mechanism having a center line along its major axis for cooperation with a follower [means] comprising:

a hollow housing having a first open end [means] and a second closed end [means];

a spring system [means] disposed within said hollow housing [means] adjacent said closed end [means];

a friction system [means] disposed adjacent said first open end [means] including;

first and second barrier [plate means] *plates* disposed on either side of said friction plate;

first and second friction [wedge means] *wedges*, said first friction wedge [means] being spaced on one side of said first barrier plate [means] and said second friction wedge [means] being spaced on one side of said second barrier plate [means], each of said first and second friction [wedge means] *wedges* having first and second angled [means] *surfaces* whereby being less adversely effected by non-normal loads transmitted by said follower [means];

first and second [shoe means] *shoes*, said first shoe [means] being disposed on one side of said first friction wedge [means] and said second shoe [means] being disposed on one side of said second friction wedge [means], each of said first and second [shoe means] *shoes* having first and second angled [means] *ends*, said first angled [means] *end* of said first and second [shoe means] *shoes* cooperating with said first angled [means] *surface* of said first and second friction [wedge means] *wedges*;

first and second wear liner [plate means] *plates*;

a release wedge [means] having [angled means] *tapered ends* cooperable with said second angled [means] *surfaces* of said first and second friction [wedge means] *wedges*; and a spring seat [means] having [an] *a pair of* angled [portion] *surfaces* cooperating with said second angled [means] *end* of said [shoe means] *shoes*.

9. The draft gear mechanism of claim 8 wherein:

said first angled [means] *surface* of *each of* said friction [wedge means cooperate] *wedges cooperates* with said first angled [means] *end* of *each of* said [shoe means] *shoes* to define an angle with respect to said center line of about 47 degrees, plus or minus 2 degrees;

said second angled [means] *end* of *each of* said [shoe means cooperate] *shoes cooperates* with said angled [means] *surfaces* of said spring seat [means] to define an angle with respect to said center line of about 66 degrees, plus or minus 2 degrees; and said second angled [means] *surfaces* of *each of* said friction [wedge means cooperate] *wedges cooperates* with said [angled means] *first and second tapered ends* of said release wedge [means] to define an angle with respect to said center line of about 60 degrees, plus or minus 2 degrees.

10. The draft gear mechanism of claim 9 wherein:

a first frictional surface is defined between said first friction wedge [means] and said first barrier plate [means];

a second frictional surface is defined between said second friction wedge [means] and said second barrier plate [means];

a third frictional surface is defined between said first shoe [means] and said first wear liner [means];

a fourth frictional surface is defined between said second shoe [means] and said second wear liner [means];

whereby in the initial one-half inch of travel of said first and second friction [wedge means] *wedges*, said first, second, third and fourth frictional surfaces are engaged;

a fifth frictional surface is defined between said first barrier plate [means] and said friction plate [means];

a sixth frictional surface is defined between said section barrier [plate means] *plates* and said friction plate [means]; and whereby after said initial one-half inch of travel of said first and second friction [wedge means] *wedges*, said fifth and sixth frictional surfaces are engaged.

* * * * *